US006422345B1

(12) United States Patent
Schwörer

(10) Patent No.: US 6,422,345 B1
(45) Date of Patent: Jul. 23, 2002

(54) DISMOUNTABLE FACADE SCAFFOLD

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 09/242,265

(22) PCT Filed: Aug. 1, 1997

(86) PCT No.: PCT/EP97/04211

§ 371 (c)(1),
(2), (4) Date: Dec. 9, 1999

(87) PCT Pub. No.: WO98/07934

PCT Pub. Date: Feb. 26, 1998

(30) Foreign Application Priority Data

Aug. 16, 1996 (DE) ..... 196 33 092

(51) Int. Cl.[7] ..... E04G 1/00; E04G 7/00
(52) U.S. Cl. ..... 182/179.1; 182/178.5
(58) Field of Search ..... 182/179.1, 186.7, 182/186.8, 178.5; 403/49, 246

(56) References Cited

U.S. PATENT DOCUMENTS

| | | | | |
|---|---|---|---|---|
| 3,564,803 A | * | 2/1971 | Breeze et al. | 182/178.5 X |
| 3,938,290 A | * | 2/1976 | Wyatt | 182/186.8 X |
| 4,830,144 A | | 5/1989 | Werner | |
| 5,135,077 A | * | 8/1992 | Shalders | 182/178.1 X |
| 5,287,947 A | * | 2/1994 | Mc Swain | 182/186.7 |
| 5,367,852 A | * | 11/1994 | Masuda et al. | 182/186.7 X |
| 5,901,810 A | * | 5/1999 | Krause | 182/178.5 |

FOREIGN PATENT DOCUMENTS

| | | | | |
|---|---|---|---|---|
| DE | 3504188 A1 | | 8/1986 | |
| DE | 9601933 | * | 1/1996 | 182/178.5 |
| DE | 19651901 A1 | | 7/1997 | |
| EP | 0234657 A2 | | 9/1987 | |
| FR | 1215292 | | 4/1960 | |
| FR | 2 247 912 | | 5/1975 | |
| FR | 2 256 998 | | 8/1975 | |
| FR | 2336532 A1 | | 7/1977 | |
| FR | 2516141 A1 | | 5/1983 | |
| FR | 2533610 A1 | | 3/1984 | |
| GD | 90 210 | | 5/1972 | |

* cited by examiner

*Primary Examiner*—Daniel P. Stodola
*Assistant Examiner*—Hugh B. Thompson
(74) *Attorney, Agent, or Firm*—Townsend and Townsend and Crew LLP

(57) ABSTRACT

A dismantlable, multi-story facade scaffold is formed of at least four vertical support elements and floor plates and railing elements which are mounted thereto. An additional scaffold story is erected by coupling an additional vertical support element to an already existing one and pivotally attaching one end of a railing element thereto at a location above where the floor plate for the next story will be placed. The other end of that railing element is pivotally attached to another vertical support element. This other vertical support element is then raised, thereby pivotally moving the rail element relative to the respective vertical support element until the rail element is in a horizontal position and the vertical support element is in the vertical position. The other vertical support element is now attached to the upper end of a corresponding vertical support of the lower scaffold story. Thereafter the floor plate for the additional scaffold story is installed so that a worker stepping on the floor plate of the higher story is protected from the very beginning against falling off. The connections between the ends of the railing and the respective vertical support elements are disengageable when they are in relatively inclined positions and become locked when the railing is perpendicular to the support elements. The scaffold is dismantled by reversing this procedure.

27 Claims, 6 Drawing Sheets

DISMOUNTABLE FACADE SCAFFOLD

BACKGROUND OF THE INVENTION

The invention relates to a dismantlable facade scaffold and to a method for the assembly and dismantling of such a facade scaffold.

Such facade scaffolds, in which the vertical support consists of support elements which can be separated from one another (CH-A-658878; GB-A-0276487), are used extensively for erection at the facade of a building in order to carry out external work there, for example applying a coat of paint.

Such facade scaffolds are generally assembled by successively erecting the individual scaffold planes, with the individual support elements of the, vertical supports of a first scaffold plane ending as a rule in each case just above a floor plate belonging to a second scaffold plane lying above it. This upper end of the support elements is then coupled by the installer to the lower end of the support elements for the second scaffold plane, in particular by means of a plug connection.

Thereafter, one or more substantially horizontally extending railing elements are mounted on the support elements in that scaffold plane (the second plane), in which the installer was present during the last discussed working step. These railing elements serve to reduce the danger of falling.

Once all the railing elements for the second scaffold plane have been installed, the floor plates belonging to the third scaffold plane lying above the second scaffold plane are coup led by the installer above his head with the previously installed support elements.

Finally, the scaffold is additionally stabilized during of the individual planes with transverse and/or diagonal struts.

In known facade scaffolds of the named kind it is a disadvantage that the installer has to work both during the erection of the support elements for the next scaffold plane and also during the installation of the railing elements for this next scaffold plane without any form of side protection, or without any form of side railing. This causes a considerable accident danger.

In order to counter this, it has already become known (FR-A-2336532) to install the railings of a new story to be erected from the already finished story and only then to place the floor plate belonging to the next story onto the already finished part of the scaffold, so that a worker treading on the new floor plate is already protected against falling by the previously installed railing. The pre-installation of the railing of the next story makes it necessary for vertical struts to extend downwardly from both sides of the railing which must first be connected to the already finished part of the scaffold and later also to the support elements of the following story.

In a further known dismantlable scaffold (FR-A-2516141) of the same kind, downwardly projecting struts are provided at one end of the railing by means of which the railing which is suspended at the other end of a vertical support can thus be swung upwardly to the next story and then secured to an already previously erected vertical support element.

The known solutions thus require additional downwardly extending vertical supports in order to move a railing element up to the next story and to secure it to the vertical support elements of the scaffold.

SUMMARY OF THE INVENTION

The object of the invention is to make available a dismantlable facade scaffold and also a method of assembling and dismantling such a facade scaffold of the initially named kind, in which not only the danger of an accident during the assembling or dismantling is reduced to a minimum, but rather the assembly/dismantling can be carried out economically in a simple manner.

Thus, in accordance with the invention, the railing elements which are pivotally connected at one end to an already installed support element are coupled at the other end to a not yet installed further support element, whereupon the further support element is lifted up, with a pivoting of the railing element into a horizontal position, and is set onto the associated support element of the already finished story. Thus, no additional vertical supports are required for the vertical pivoting of the railing element, but rather the support element which later forms a component of the scaffold is itself used.

Since, with facade scaffolds, several vertical units are as a rule erected alongside one another, with their floor plates adjacent to one another in a plane, it is sensible to design the coupling between the railing elements and the support elements so that two railing elements can be secured at one end of a support element and can then respectively extend horizontally in opposite directions.

A particularly simple coupling between railing elements and support elements results when the railing elements can be hung into the fastening positions of the support element provided for this purpose. In this respect it is again of advantage when the suspended connection is equipped with a security device against unintentional release in order to ensure, in this manner, that the railing element is reliably connected to the support element when a horizontally directed force is exerted on a railing element, such as for example occurs when an installer leans against the railing element.

The said securing device is preferably so designed that it is achieved solely by the coupling of the railing element and the support element, without special devices having to be actuated for this purpose or without the installer having to carry out additional manual actions.

The suspended connection is preferably realized by a projection element which extends substantially perpendicular to the support element and is fixedly connected to the latter, and also by a lug provided at the end region of the railing element and which can be coupled to the projection element. It is an advantage of this embodiment that moveable parts do not need to be provided either at the railing element or at the support element.

The projection element is preferably executed as a stamped part, which can for example be welded onto the support element. Thus, the manufacturing costs can be restricted to a minimum because the stamping procedure can be carried out at low cost.

The projection element can, for example, be made substantially areal or flat, with it naturally having to have a certain thickness in order to be able to withstand the forces which arise.

In one possible embodiment of the projection element, the latter is provided with at least two mutually displaced projections at its upper and lower sides in each case. In this case the lug of the railing element can be threaded onto the projection element while executing pivotal movements when the railing element is aligned perpendicular to the support element, with the lug being moved over one projection of the projection element during each pivotal movement. Through sequential, opposite pivotal movements the lug is thereby alternatively moved over the projections provided at the upper and lower side of the projection element.

It is preferred when the lug is executed as an elongate slot which extends in the longitudinal direction of the railing elements, since in this case the lug can be pushed onto the projection element while executing a substantially linear movement, when the support element and the railing element include an angle, which is for example smaller than 45°. The support element and the railing element include an angle of this kind at the stage of the erection or dismantling in which the railing element has a free end, i.e. an end which is not coupled to a support element, and the other end is connected to a support element or to be released from such an element.

In this case the coupling position between the support element and the railing element stands, for example, approximately three meters above the floor plate, on which the installer is actually standing, so that it is of advantage when the corresponding coupling can be easily produced or cancelled by a simple linear movement.

In a preferred embodiment of the invention two fastening positions, in each case for a separate railing element, are provided with an erected scaffold above the fastening position of this support element provided for the floor plate. Thus, two railing elements can be provided at different spacings from the floor plate which is subsequently to be installed, whereby the side protection to be brought about is increased.

The distance between the fastening position provided for the second railing element and the fastening position provided for the floor plate amounts, by way of example, to between 30 cm and 70 cm, in particular to approximately 50 cm. It is consequently possible to provide, for example, two railing elements at a distance of 50 cm and 100 cm from the floor plate.

The number of parts which have to be moved during erection and dismantling can in the latter case be reduced if the two railing elements belonging to a support element are pivotally connected together. This pivotal connection makes it possible for the two railing elements to be jointly swung upwardly in the manner already described above into their horizontal position. Instead of two individual railing elements, it is, however, only necessary to move one part which embraces the two railing elements and an additional stabilization of the overall scaffold is achieved by the said hinged connection of the two railing elements.

The effective total length of a support element with an erected scaffold can amount to between 180 cm and 220 cm, in particular to approximately 200 cm.

The effective total length in the erected scaffold of a support element which can be inserted into the lowermost scaffold plane can amount to between 280 cm and 330 cm, in particular to approximately 300 cm, and a support element of this kind can have two fastening positions for two base plates which are to be arranged in different scaffold planes. With support elements dimensioned in this way a situation is avoided in the lowermost scaffold plane in which a joint position or coupling position already has to be provided in this scaffold plane between two support elements arranged above one another, which would form a weak point of the overall scaffold as a result of the high forces which act in the lowermost plane.

The number of the parts which have to be moved during installation and dismantling can be additionally reduced in that two support elements aligned parallel to one another, and which come to lie at the narrow side of a floor plate, in particular when the scaffold is erected, are fixedly connected to one another via a transverse brace. In this case an at least approximately H-shape results for the two support elements connected to one another.

Since scaffolds erected in front of facades frequently only require railing elements at one side, it is sufficient with support elements which are connected to one another in the described manner when only one of these two support elements has at least one fastening position for a railing element.

In the context of the support elements connected to one another, it is possible to connect two support elements to one another which have different lengths, or substantially the same length, but are displaced relative to one another in the vertical direction.

DESCRIPTION OF THE PREFERRED EMBODIMENTS

Figure 1:
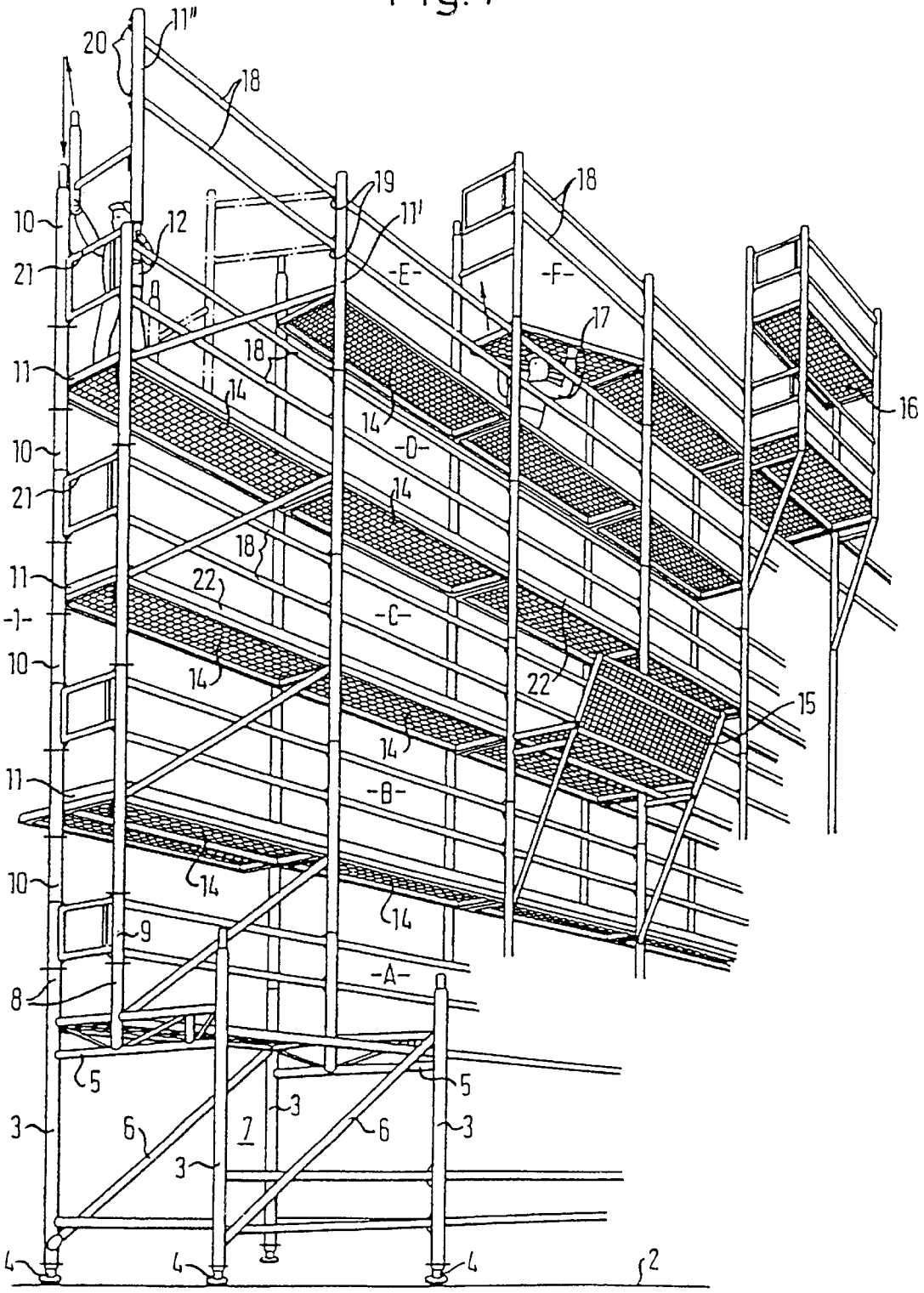
FIG. 1 is a perspective view of a facade scaffold in accordance with the invention in the course of being built up.

In accordance with FIG. 1, a facade scaffold is in the course of being erected at a building 1. Four support elements 3 are braced against the ground 2 to form vertical supports in an arrangement with a rectangular base surface, with the longer side of the rectangular base surface extending parallel to the front side of the building 1.

The support elements 3 associated with the lowermost scaffold plane are supported at the base side via vertically adjustable spindle arrangements 4 and are completed by transverse beams 5 and diagonal struts 6 into a load carrying base frame 7. This base frame 7 is continued to the right in FIG. 1 in a corresponding manner which is not, however, illustrated for reasons of clarity.

Further support elements which are partly braced together are pushed onto two rear vertical support projections 8 of the base frame 7 arranged behind one another at a small spacing in order to form vertical supports. In the story A, which directly adjoins the base frame 7, an intermediate piece 9, a connection piece 10 and also an end frame 11 are provided as support elements, with the end frame 11 consisting of two support elements extending parallel to one another and fixedly connected together via transverse strut or brace.

For the further stories B to F, which follow the story A, further connection pieces 10 and end frames 11 are pushed onto the support elements or onto the connection piece and the end frame 11 of the story A. The shape of an end frame 11 can be particularly well seen for the end frame 11 provided for the story E, which is actually being held by an installer 12 in the erection step shown in FIG. 1.

The joints between the base frame 7, intermediate pieces 9, connection pieces 10 and end frame 11, at which respective plug connections are provided, are characterized for the end regions of the overall scaffold in FIG. 1 by short horizontal lines.

The assembly scheme for the vertical supports of FIG. 1 will be described once again in the following with an explanation of FIG. 4*b*.

Provided along the building 1 at uniform intervals there are a total of seven vertical support arrangements consisting of intermediate pieces 9, connection pieces 10 and end frames 11 put together vertically above one another.

Respective rectangular floor plates 14 are held between two vertical support arrangements arranged in series along the building 1 and ultimately form the different working planes for the individual stories A to F.

The facade scaffold has furthermore two forwardly projecting auxiliary scaffolds 15 and 16 respectively.

In order to secure the people 12, 17 working on the floor plates 14, railing elements 18 are provided at a suitable height at the front sides of the end frames 11. The installation of these railing elements takes place in a manner in accordance with the invention in that in each case first the railing elements 18 of one story are installed, and only then the floor plate 14 belonging to this story.

In the embodiment of the invention shown in FIG. 1, the railing elements 18 are first secured at the fastening positions 19 of the end frame 11' by the installer 12. Thereafter, the end frame 11" is connected at the fastening positions 20 to the end of the railing elements 18 remote from the fastening positions 19, so that the two end frames 11', 11" jointly form a parallelogram with the two railing elements 18. It is of importance that the railing elements

18 are hingedly mounted on the end frames 11', 11" so that it is possible for the installer 12 to grasp the entire arrangement at the end frame 11" and swing it upwardly in the direction of the arrow in order to subsequently enable the end frame 11" to be plugged onto the lower lying end frame 11 and the lower lying connection piece 10 respectively.

Through the above-described working step the railing 18 for the story E has already been installed before the introduction of the floor plate provided for the story E. As a consequence, it is ensured that at the time at which the floor plate 14 is secured to the story E, a side protection in the form of the railing elements 18 already exists so that the danger of an installer working on the story E falling is already reduced from the outset to a considerable degree.

End railings 21 are respectively provided at the ends of the total scaffold in addition to the railing elements 18.

Curb strips 22 are releasably secured, in particular to the side of the floor plates 14 remote from the building 1 and, if necessary, also at the side adjacent the building 1 and at the end sides, and are intended to prevent tools which lie on the floor plates 14 being pushed sideways over the edge of the floor plates 14 when walking on them and thus to prevent the tools being able to fall downwardly from the facade scaffold.

The scaffold has four already finished stories A, B, C and D and two which are already under construction, E and F respectively.

FIG. 2 shows individual working steps during the erection of a facade scaffold in accordance with the invention.

Figure 2A:
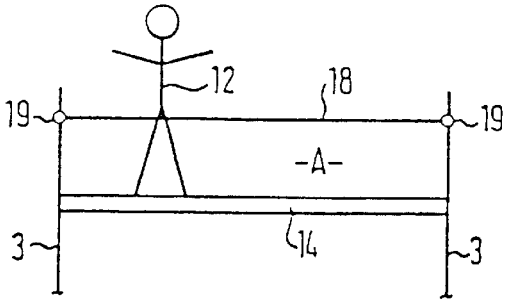
FIGS. 2*a*–2*f* show a schematic illustration of a total of six working steps which have to be completed when building up a facade scaffold in accordance with the invention.

In the working step of FIG. 2*a* the installer 12 is standing on a floor plate 14 which is associated with the story A. The installer 12 is secured during this by at least one railing element 18, which is coupled at the fastening positions 19 to vertically extending support elements 3.

Figure 2B:
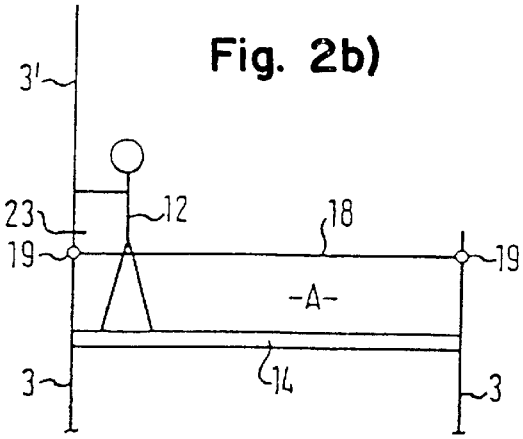

In the working step of FIG. 2*b* the installer 12 is placing a further support element 3' on the support element 3, with the joint 23 between the support elements 3, 3' being realized by a plug connection.

Subsequently, in accordance with FIG. 2*c*, a further railing element 18' is suspended at one end at a fastening position of the support element 3' provided for this purpose. After this railing element 18' has been coupled at its other end to a further support element 3", the railing element 18' is swung upwardly together with the support element 3" in accordance with FIG. 2*d* in the direction of the arrow, whereupon, in accordance with FIG. 2*e*, the support element 3" is plugged onto the lower lying support element 3 at 23'.

Figure 2C:
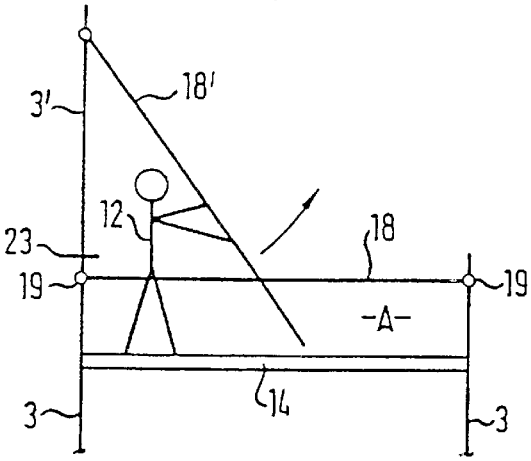
Figure 2D:
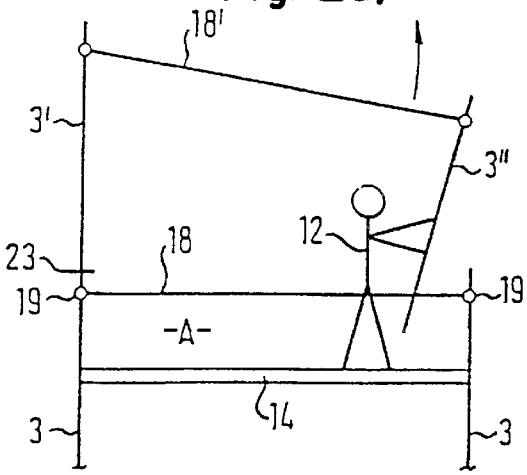
Figure 2E:
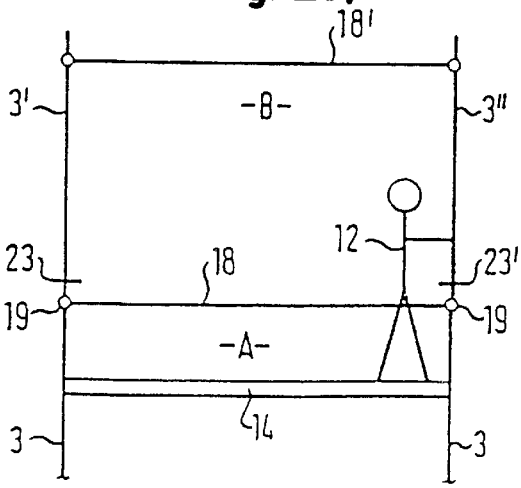

In this position shown in FIG. 2*e*, the railing element 18 is consequently already erected for the story B lying above the story A before the floor plate 14' required for the story B was secured.

Figure 2F:
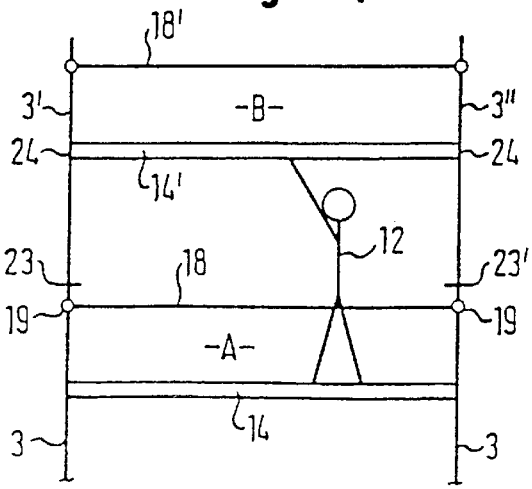

In accordance with FIG. 2*f* the floor plate 14' for the story B is finally attached to the fastening positions 24 of the support elements 3', 3" provided for this purpose. Thereafter, the story B can be walked on for the first time by the installer 12 and at this point in time the railing 18' is, however, already installed so that a side protection exists for the installer.

It should be remarked that the floor plates 14, 14' in accordance with the invention can basically be secured either directly to the support elements 3, 3', 3" or also indirectly, for example via transverse struts which are connected to the support elements 3, 3', 3".

Figure 3:
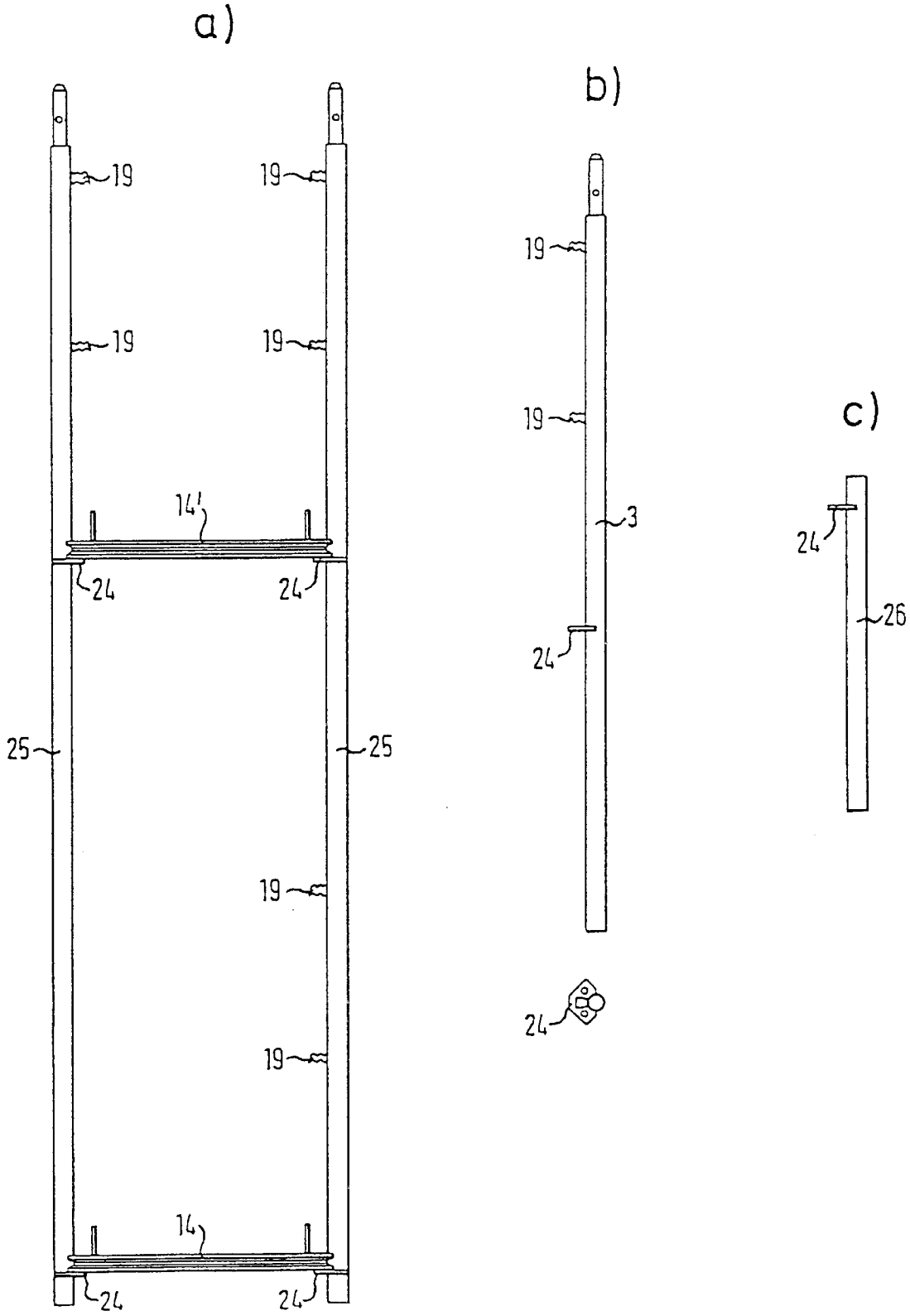
FIGS. 3*a*–3*c* show different individual elements of a facade scaffold in accordance with the invention.

FIG. 3 shows different vertical support elements which can be used in the context of the invention for the erection of a scaffold.

FIG. 3*a* shows two support elements which are approximately three meters long which are intended for use in the lowermost plane of the scaffold.

At the lower end and also at a height of approximately two meters, the support elements 25 have respective fastening positions 24 for floor plates 14, 14'. Thus two floor plates 14, 14' for two different scaffold planes can be secured to the support elements 25.

Approximately 50 cm above and also approximately 100 cm above the two fastening positions 24 for the floor plates 14, 14' there are fastening positions 19 for railing elements, which are not shown in FIG. 3.

At least one of the two support elements 25 thus has fastening positions 19 for railing elements of two scaffold planes lying above one another.

The embodiment of FIG. 3*a* of support elements 25 for the lowermost scaffold plane is of advantage, because in this manner no joint positions or plug connections are present in the lowermost plane, which impair the stability of the overall scaffold.

In FIG. 3*b* there is shown a support element 3 which can be used for all scaffold planes which follow the support elements 25. This support element 3 can be plugged at its lower end onto the upper end of the support element 25 of FIG. 3*a*.

In accordance with the invention, two fastening positions 19 of the support element 3 intended for railing elements are located above a fastening position 24 provided for a floor plate.

The effective overall length of the support element in accordance with FIG. 3*b* amounts to approximately two meters.

In the lower region of FIG. 3*b* the fastening position 24, which is formed as a rose, is shown in plan view and has apertures for the hanging into place of the floor plates.

FIG. 3*c* shows a special embodiment of a support element 26, which can be used in the context of the invention and which only has one fastening position 24 for a floor plate at its upper end. A support element 26 of this kind can, for example, be used in the uppermost scaffold plane in which, in certain applications, the vertical supports adjacent the building are located beneath a roof projection so that care can be taken here by means of the short support element 26 of FIG. 3*c* that the roof projection and the support element do not collide with one another.

In the embodiment of FIG. 3 the vertical supports are built up exclusively of individual supports, with any eventual connections between adjacent support elements being produced exclusively via releasable connections.

Figure 4A:
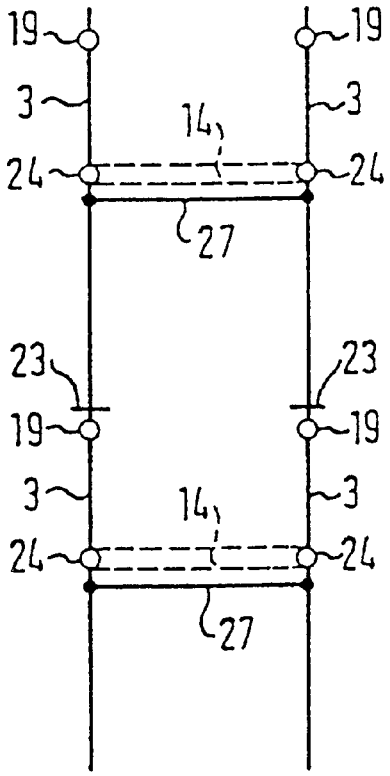
FIGS. 4*a*, 4*b* show two variants for the coupling of support elements which respectively extend parallel to one another.

In contrast to this, FIG. 4*a* illustrates how two support elements 3 are fixedly connected to one another via a transverse brace 27 to form an end frame. The overall arrangement of a support element 3 and transverse brace 27 thereby forms an H-like structure.

Just above the transverse brace 27 are fastening positions 24 for a floor plate 14, which is shown in broken lines. Alternatively, the fastening position 24 could also be spared in this case if the transverse brace is used as a support and thus as a fastening position for the floor plate 14.

Further fastening positions 19 for railing elements not shown in FIG. 4*a* are provided approximately one meter above the fastening positions 24.

Individual end frames in accordance with FIG. 4*a* can be plugged into one another via plug connections 23.

Through this embodiment the number of parts which have to be moved during erection and dismantling are reduced, since in each case two support elements 3 are combined together to a single element via the transverse brace 27.

Figure 4B:
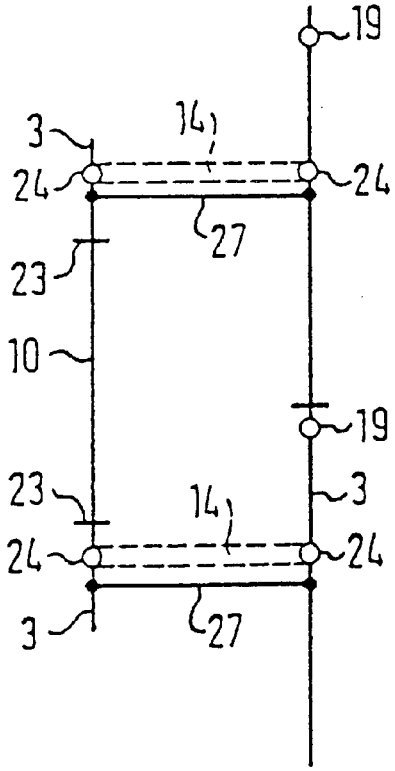

An alternative embodiment is shown in FIG. 4*b*. This embodiment corresponds to the embodiment in accordance with FIG. 1.

Here, the two support elements 3 which are to be connected together via the transverse brace 27 have different lengths. As one support element 3 is shortened relative to the embodiment of FIG. 4*a*, the total weight of the end frame 3, 27 can be reduced in this way. However, allowance must be made for the fact that the individual end frames have to be coupled.

It should be expressly mentioned at this point that for the additional reduction of the number of parts which have to be moved, the railing elements in all embodiments in accordance with FIGS. 3 and 4 can also be fixedly hinged to the fastening positions 19 provided for this, so that a fixed but hinged connection is already present in the support elements 3 and the railing elements 18 prior to the installation.

Figure 5:
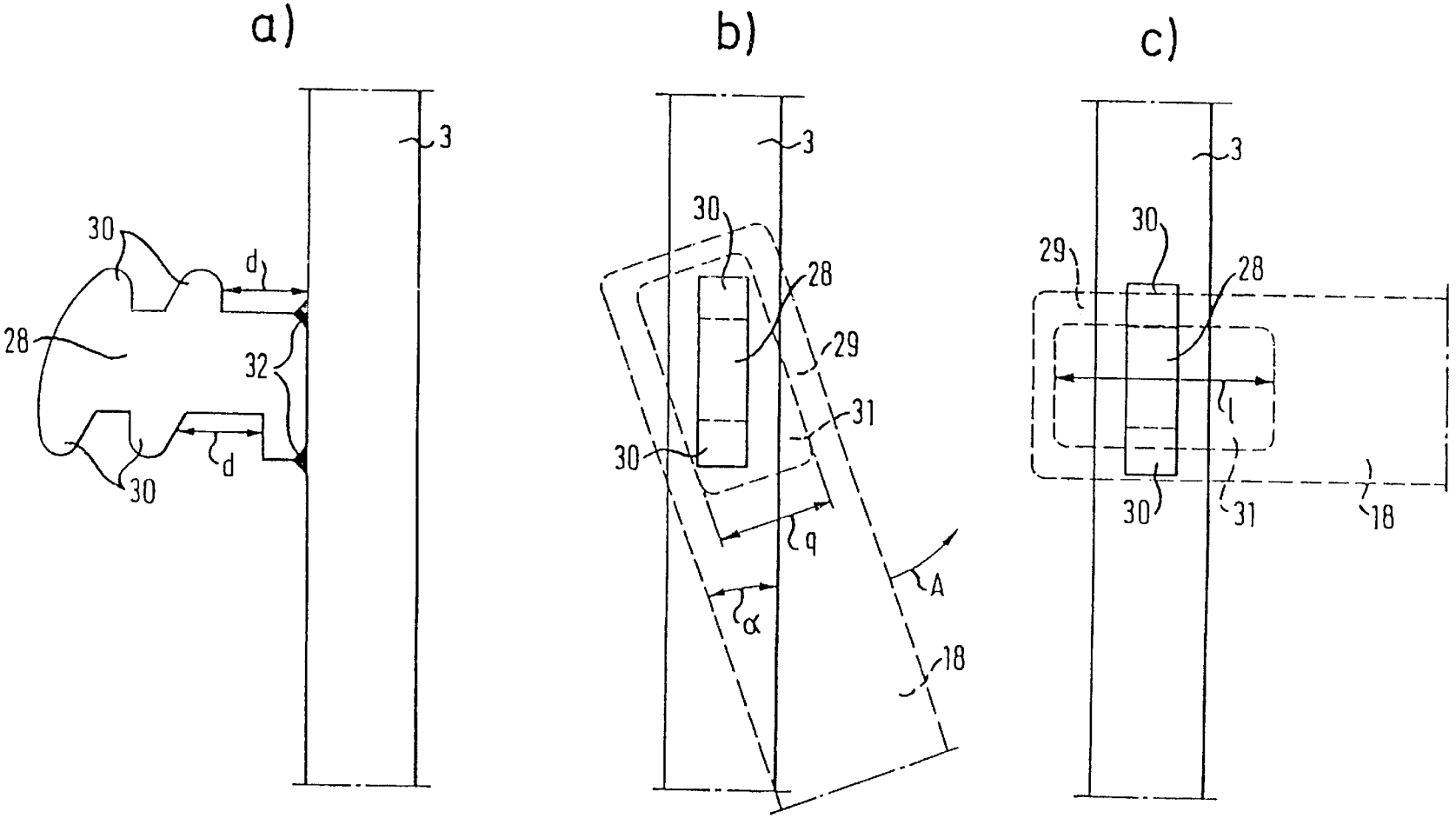
FIGS. 5*a*–5*c* show an example for the design of the fastening device for the attachment of a railing element to a support element.

FIG. 5 shows the manner in which railing elements 18 can be coupled to the support elements 3.

With the illustrated way of coupling, this is essentially a suspended connection, which is realized by a projection element 28 extending substantially perpendicular to the support element 3 and also by a lug 29 provided in the end region of a railing element 18 and capable of being coupled to the projection element 28. The projection element 28 is fixedly connected to the support element 3, and is in particular welded to it at 32.

The projection element 28 has, at its upper side and lower side, displaced relative to one another, in each case two projections 30.

The transverse dimension q of the aperture 31 of the lug 29 is so selected that the railing element 18 can also be threaded onto the projection element 18 while executing alternating pivotal movements. In this respect the dimension q is precisely selected such that threading on is possible unhindered but cannot, however, be brought about by means of a linear movement of the railing element 18 or of the lug 29, when the railing element 18 and the support element 3 are aligned approximately perpendicular to one another.

The fact that the pivotal or threading movement is necessary to secure the railing element 18 to the support element 3 ensures that the railing element 18 cannot be released in unintentional manner by the action of horizontally directed forces from the support element 3. This security is, moreover, favored by the fact that the abutment surface of the projection 30 of the projection element 28 disposed closest to the support element 3 extends vertically and thus parallel to the support element 3.

The further abutment surfaces of the projections 30 can, for example, be obliquely executed in order to facilitate the threading on of the lug 29 in this way.

The spacing d between the abutment surfaces of the projections 30 facing the support elements 3 and the support element 3 is so selected that the lugs 29 of two railing elements 18 extending in opposite directions can be threaded onto a single projection element 28.

On attachment of the first end of one railing element 18 to the projection element 28, the railing element 18 has the position relative to the projection element 28, which is for example shown in FIG. 2 (see also FIG. 2*c*).

The angle a enclosed between the sup,port element 3 and the railing element 18 is in this case smaller than 60° and preferably smaller than 45°.

As a result of the aperture 31 of the lug 29, which is formed as an elongate slot with the length 1, a plugging of the railing element 18 onto the projection element 28 is possible in this position by the execution of a purely linear movement. Thereafter, the railing element 18 is then swung in the direction of the arrow A upwardly about the projection element 28 into a horizontal position shown in FIG. 5*c*.

In this position it is no longer the longitudinal dimension 1 of the aperture 31 but rather its transverse dimension q which is the determining factor, with respect to the cooperation between the lug 29 and the projection element 28.

As a result of the already described dimensioning of q, a situation is effectively prevented in the position of FIG. 5*c* in which the railing element 18 could be released from the projection element 28 by a purely linear movement. A release of this kind is only possible by the intentional execution of several sequential pivotal movements.

In the context of the system of the invention, the first end of the railing element 18 is coupled to the support element 3 in the manner shown in FIGS. 5*b* and 5*c*, while the other end is threaded onto the second support element 3 by executing pivotal movements.

Figure 6:
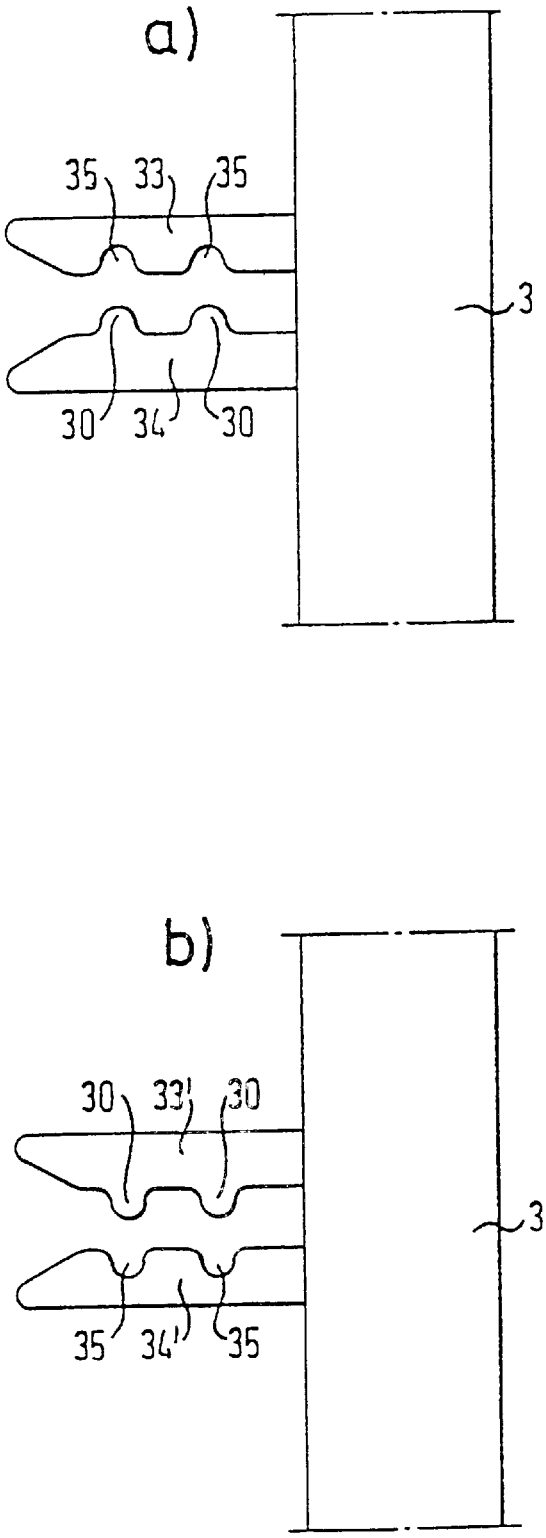
FIGS. 6*a*, 6*b* show two further alternatives with respect to the fastening device of FIG. 5.

FIG. 6 shows alternative embodiments of the projection element of FIG. 5.

In FIG. 6*a* the projection element is formed by two part elements 33, 34 arranged above one another, with the lower part element 34 having two upwardly extending projections 30, and the upper part element having two recesses 35 at its lower side aligned with the projections 30.

The operating principle corresponds here to the operating principle of FIG. 5, with the lug 29 being threaded over the lower part element 34.

FIG. 6*b* shows an embodiment corresponding to that of FIG. 6*a*, only with projections 30 and recesses 35 being arranged in reversed manner on the upper and lower part elements 33', 34' respectively.

The invention is not restricted to the above-described embodiments. Many other variants can be realized within the context of the disclosure.

What is claimed is:

1. Dismantlable facade scaffold comprising at least four vertical supports consisting of individual support elements and floor plates and railing elements which can be mounted thereon story-wise, wherein at least some of the support elements have mounting locations for the floor plates and for the railing elements respectively, wherein, when the scaffold is erected, at least one attachment position of a first support element provided for a railing clement is located above a fastening position of the first support element provided for a floor plate and the railing element, starting from an already finished story and in an inclined state with one end at the attachment position of a second support element already belonging to a next story, can be swung vertically about at least one axis extending substantially horizontally through the attachment position for fixation to the first and second support elements while in a substantially horizontal orientation, wherein the support elements are separable from one another directly above the attachment position of an uppermost railing element of each story and another end of the railing element is pivotally connected to an upper attachment position of a second support element and can be moved by means of the second support element into its final horizontal position, whereupon the second support element is placed onto the associated support element of the already finished story, wherein the railing elements can be suspended in the inclined state at the attachment positions of the support elements, a device preventing an unintentional release of the railing elements from the attachment positions comprising a projection piece extending substantially perpendicular to the support element and fixedly connected thereto and a lug provided at an end region of the railing element which is capable of being coupled to the projection piece, and wherein the lug can be pushed onto the projection piece by a substantially linear movement when the support element and the railing element are inclined with respect to each other by an angle smaller than 60°.

2. Dismantlable facade scaffold in accordance with claim 1, wherein a distance between the fastening position provided for the railing element and the fastening position provided for the floor plate amounts to between 70 cm and 130 cm.

3. Dismantlable facade scaffold in accordance with claim 1, wherein, when the scaffold is erected, the support element extends downwardly beyond the fastening position provided for the floor plate over a length between 60 cm and 100 cm.

4. Dismantlable facade scaffold in accordance with claim 1, wherein the raring elements are formed as horizontally extending bars in the assembled scaffold.

5. Dismantlable facade scaffold in accordance with claim 1, wherein first and second railing elements can be coupled to the attachment position of the first and second support elements.

6. Dismantlable facade scaffold in accordance with claim 1, wherein the railing elements can be released from the attachment positions when the railing elements are in the inclined state.

7. Dismantlable facade scaffold in accordance with claim 1, wherein the projection piece comprises a stamped part.

8. Dismantlable facade scaffold in accordance with claim 1, wherein the projection piece has a substantially flat configuration.

9. Dismantlable facade scaffold in accordance with claim 1, wherein the projection piece has at least two projections displaced relative to one another at each of its upper and lower sides.

10. Dismantlable facade scaffold in accordance with claim 1, wherein the lug includes an elongate slot extending in a longitudinal direction of the railing element.

11. Dismantlable facade scaffold in accordance with claim 1, wherein, when the railing element is oriented perpendicular to the support clement, the lug can be threaded onto the projection piece by pivotal movements.

12. Dismantlable facade scaffold in accordance with claim 1, wherein, when the scaffold is erected, two fastening positions of the support element are located above the fastening position of the same support element provided for the floor plate for first and second railing elements.

13. Dismantlable facade scaffold in accordance with claim 12, wherein a distance between the fastening position provided for one of the railing elements and the fastening position provided for the floor plate amounts to between 30 cm and 70 cm.

14. Dismantlable facade scaffold in accordance with claim 12, wherein the railing elements are hingedly connected to the support elements.

15. Dismantlable facade scaffold in accordance with claim 1, wherein an effective total length of the second and third support elements with the scaffold erected amounts to between 180 cm and 220 cm.

16. Dismantlable facade scaffold in accordance with claim 1, wherein, when the scaffold is erected, an effective total length of the support element usable in a lowermost scaffold plane amounts to between 280 cm and 320 cm, and the support element has two fastening positions for two floor plates to be arranged in different scaffold planes.

17. Dismantlable facade scaffold in accordance with claims 1, including plug connections for coupling the support elements together to form the vertical supports.

18. Dismantlable facade scaffold in accordance with claim 1, including a transverse brace fixedly connecting the first and second support elements in parallel alignment.

19. Dismantlable facade scaffold in accordance with claim 18, wherein only one of the two connected support elements has at least one fastening position for at least one railing element.

20. Dismantlable facade scaffold in accordance with claim 18, wherein the two connected support elements have different lengths.

21. Dismantlable facade scaffold in accordance with claim 1, wherein two attachment positions provided for railing elements are located above one another within one story and above an attachment position for the floor plate.

22. Dismantlable facade scaffold comprising at least four vertical supports consisting of individual support elements and floor plates and railing elements which can be mounted thereon story-wise, wherein at least some of the support elements have mounting locations for the floor plates and for the railing elements respectively wherein, when the scaffold is erected, at least one attachment position of a first support element provided for a railing element is located above a fastening position of the first support element provided for a floor plate and the railing element, starting from an already finished story and in an inclined state with one end at the attachment position of a second support element already belonging to a next story, can be swung vertically about at least one axis extending substantially horizontally through the attachment position for fixation to the first and second support elements while in a substantially horizontal orientation, wherein the support elements are separable from one another directly above the attachment position of an uppermost railing element of each story and another end of the railing element is pivotally connected to an upper attachment position of a second support element and can be moved by means of the second support element into its final horizontal position, whereupon the second support element is placed onto the associated support element of the already finished story, wherein the railing elements can be suspended in the inclined state at the attachment positions of the support elements, a device preventing an unintentional release of the railing elements from the attachment positions comprising a projection piece extending substantially perpendicular to the support element and fixedly connected thereto and a lug provided at an end region of the railing element which is capable of being coupled to the projection piece, and wherein, when the railing element is oriented perpendicular to the support element, the lug can be threaded onto the projection piece by pivotal movements.

23. Dismantlable facade scaffold in accordance with claim 22, wherein the lug can be pushed onto the projection piece by a substantially linear movement, when the support element and the railing element are inclined with respect to each other by an angle smaller than 60°.

24. A method of erecting a dismantlable multi-story facade scaffold, each facade story having at least four vertical supports defined by upright, individual support elements, a floor plate and a railing element carried by the support elements, the support elements having fastening positions for the floor plates and attachment positions for the railing elements located above the fastening positions so that, for each story of the scaffold, the railing elements, when installed, are substantially horizontally oriented and vertically spaced above the associated floor plate, the method comprising erecting a further scaffold story on top of an already erected scaffold story by attaching a further support element onto an upper end of one of the support elements of the already erected scaffold story at a point located directly above the attachment position of the railing element of the already erected scaffold story, pivotally attaching an end of a further railing element to the further support element at a location above the already erected scaffold story while the further railing element is angularly inclined with respect to the further support element, pivotally connecting an additional support element to another end of the further railing element while the further railing element is in its inclined position, grasping the additional support element and with it pivotally moving the further railing element relative to the support elements to which it is attached from its inclined position into a substantially horizontal position by raising a pivotal connection between the further railing element and the additional support element until the additional support element is in a substantially vertical orientation, connecting a lower end of the additional support element to a corresponding support element of the already erected scaffold story at a fastening position defined by the upper end of the corresponding support element, thereafter raising an additional floor plate from the already erected scaffold story upwardly, and connecting the raised, additional floor plate to the attachment position of the vertically oriented, additional support element.

25. A method for dismantling a dismantlable facade scaffold having at least an upper and a lower scaffold story, each scaffold story being formed by at least four spaced-apart vertical support elements, a floor plate detachable carried by corresponding mounting positions on the support elements and at least one substantially horizontally oriented railing element located above the floor plate and extending between a pair of support elements and having respective ends pivotally attached to the support elements in a manner so that the ends of the railing element are secured to the support elements when the railing element is substantially perpendicular to the support elements and so that the ends of the railing element can be detached from the associated support elements when the railing element is at an angular inclination relative to the support elements, the method comprising removing the floor plate of the upper story from the mounting positions of the support elements while the support elements and the railing of the upper story are perpendicular with respect to each other, thereafter disconnecting one of the support elements of the upper story from the corresponding support element of the lower story, lowering the disconnected support element by pivotally moving the ends of the railing element relative to the support elements to which it is attached until the relative angular position of the ends of the railing element is such that the railing element can be detached from the support elements to which it is attached, and thereafter disconnecting the other one of the other support element to which the railing is attached from the associated lower support element.

26. Dismantlable facade scaffold comprising at least four vertical supports consisting of individual support elements and floor plates and railing elements which can be mounted thereon story-wise, wherein at least some of the support elements have mounting locations for the floor plates and for the railing elements respectively, wherein, when the scaffold is erected, at least one attachment position of a first support element provided for a railing element is located above a fastening position of the first support element provided for a floor plate and the railing element, starting from an already finished story and in an inclined state with one end at the attachment position of a second support element already belonging to a next story, can be swung vertically about at least one axis extending substantially horizontally through the attachment position for fixation to the first and second support elements while in a substantially horizontal orientation, wherein the support elements are separable from one another directly above the attachment position of an uppermost railing element of each story and another end of the railing element is pivotally connected to an upper attachment position of a second support element and can be moved by means of the second support element into its final horizontal position, whereupon the second support element is placed onto the associated support element of the already finished story, wherein the railing elements can be suspended in the inclined state at the attachment positions of the support elements, a device preventing an unintentional release of the railing elements from the attachment positions comprising a projection piece extending substantially perpendicular to the support element and fixedly connected thereto and a lug provided at an end region of the railing element which is capable of being coupled to the projection piece, and wherein the projection piece is forced by an upper and a lower part element, the lower part element having first and second upwardly extending projections, and the upper part element having at least two recesses at its underside and aligned with the projections.

27. Dismantlable facade scaffold comprising at least four vertical supports consisting of individual support elements and floor plates and railing elements which can be mounted thereon story-wise, wherein at least some of the support elements have mounting locations for the floor plates and for the railing elements respectively, wherein, when the scaffold is erected, at least one attachment position of a first support element provided for a railing element is located above a fastening position of the first support element provided for a floor plate and the railing clement, starting from an already finished story and in an inclined state with one end at the attachment position of a second support element already belonging to a next story, can be swung vertically about at least one axis extending substantially horizontally through the attachment position for fixation to the first and second support elements while in a substantially horizontal orientation, wherein the support elements are separable from one another directly above the attachment position of an uppermost railing element of each story and another end of the railing element is pivotally connected to an upper attachment position of a second support element and can be moved by means of the second support element into its final horizontal position, whereupon the second support element is placed onto the associated support element of the already furnished story, wherein the railing elements can be suspended in the inclined state at the attachment positions of the support elements, a device preventing an unintentional release of the railing elements from the attachment positions comprising a projection piece extending substantially perpendicular to the support element and fixedly connected thereto and a lug provided at an end region of the railing element which is capable of being coupled to the projection piece, and wherein the projection piece is formed by an upper and a lower part element arranged above one another, the lower part element having at its upper side at least two recesses and the upper part element having first and second downwardly extending projections aligned with the recesses.

* * * * *